United States Patent [19]

Alsen et al.

[11] 4,228,114

[45] Oct. 14, 1980

[54] METHOD FOR THE CONSTRUCTION OF ELONGATED CONCRETE STRUCTURES SUCH AS BRIDGES AND THE LIKE

[75] Inventors: Klaus Alsen; Hans Neidhardt, both of Wiesbaden; Jürgen Maletzke, Mainz; Johann Wimmer, Hochheim, all of, Fed. Rep. of Germany

[73] Assignee: Dyckerhoff & Widmann Aktiengesellschaft, Munich, Fed. Rep. of Germany

[21] Appl. No.: 945,843

[22] Filed: Sep. 26, 1978

[30] Foreign Application Priority Data

Sep. 27, 1977 [DE] Fed. Rep. of Germany ..... 2743273

[51] Int. Cl.² ..... E01D 21/04

[52] U.S. Cl. ..... 264/33; 264/34; 425/63

[58] Field of Search ..... 264/31–34; 425/63, 65; 249/20

[56] References Cited

U.S. PATENT DOCUMENTS 3,831,902 8/1974 Vanderklaauw ..... 264/34 X

FOREIGN PATENT DOCUMENTS 1237603 3/1967 Fed. Rep. of Germany .

*Primary Examiner*—Thomas P. Pavelko

*Attorney, Agent, or Firm*—Toren, McGeady and Stanger

[57] ABSTRACT

An elongated concrete structure, such as a bridge, is constructed by providing at a construction zone located at one end of the site of the structure a formwork arrangement which includes a bottom formwork within which the structure may be formed in discrete sections. Successive discrete sections formed in the formwork are joined together and launched in series from the construction zone toward the opposite end of the site across which the structure is to extend. As each section of the structure is launched, the bottom formwork is moved together with each section across one section length in the launching direction while the remainder of the formwork arrangement is maintained stationary at the construction zone.

4 Claims, 8 Drawing Figures

H
1
2
3
4
5
6
7
8
9

A
B
C
III
IV
V
1
6
10
11
13
14
17
18
19
20
21
27
29
30
31

METHOD FOR THE CONSTRUCTION OF ELONGATED CONCRETE STRUCTURES SUCH AS BRIDGES AND THE LIKE

BACKGROUND OF THE INVENTION

The present invention relates generally to a construction method and more particularly to a method for constructing an elongated concrete structure, particularly a multiple-span bridge superstructure made of reinforced or prestressed concrete. The invention is especially concerned with a construction technique wherein a formwork device arranged in the immediate vicinity of one end of the site across which the structure is to extend is utilized to form the structure in discrete successive sections, with each section being connected to a previously formed section by means of untensioned or prestressed connecting reinforcement elements which are moved together with the sections progressively and in series toward the opposite side of the site of the structure.

A prior art method of the type herein discussed is known under the designation "incremental launching method" (see German Pat. No. 1,237,603). In this method, the bottom slab of a hollow box is first constructed on a lowerable bottom formwork at the location where the sections of the structure are constructed. The bottom formwork is displaced relative to the actual stationary formwork from the hollow box by the length of a section of the structure. The bottom formwork is lowered after the concrete of the bottom slab has hardened. During this procedure, the slab is placed on prepared slide bearings upon which the slab is moved. Subsequently, upper portions of the respective sections of the structure are constructed in the region of the stationary formwork which also includes an internal formwork. The internal formwork is moved back after the respective sections of the structure have been moved forwardly.

Each completed section of the structure is moved by a device which consists of a combination of vertically and horizontally acting hydraulic press means. By operation of the vertically acting press means, a slight lifting of the superstructure produces a friction grip between the press and the superstructure as a result of which the horizontally acting press means may then effect a desired forward movement. In order to enable lowering of the formwork for the bottom slab, it is necessary to provide a sufficient space beneath the formwork. This leads to the formation of a so-called "cellar" beneath the construction site.

In the incremental launching method many simplifications in the construction of elongated structures are facilitated. For example, the formwork mechanism may be reused repeatedly. On the other hand, the method is rather expensive and it can, therefore, only be used advantageously in the construction of long and heavy bridges.

The present invention is directed to providing means whereby procedures such as the incremental launching method may be simplified particularly with respect to the material and time requirements involved in bridge construction. The invention thus is directed toward making such methods useful for smaller bridges.

SUMMARY OF THE INVENTION

Briefly, the present invention may be described as a method for constructing elongated structures, particularly multiple-span bridge superstructures of reinforced or prestressed concrete, across an erection site including the steps of providing at a construction zone at one end of the site across which the structure is to extend formwork means including a bottom formwork within which the structure is formed in discrete sections. The discrete sections are successively formed in the formwork means and each of the successively formed sections is joined to the previously formed section, with the sections being then launched in series from the construction zone toward the opposite end of the site across which the bridge or structure is to extend. The present invention particularly relates to the improvement wherein the bottom formwork is moved together with each section formed at the construction zone through a distance equivalent to the length of one section taken in the launching direction while the remainder of the formwork means are retained stationary at the construction zone.

Thus, in the solution provided by the invention, stationary parts of the formwork are maintained at the construction zone with the bottom formwork of each section under construction being launched together with the section of the structure in the direction along which the bridge is to be formed.

The advantages of the invention reside, first of all, in the fact that expenditures for a substructure beneath the construction point or zone are significantly reduced because parts of the bottom formwork which are to be separated from the concrete are not lowered but are instead taken along in the direction of launching on slide tracks until they free themselves at a point forwardly of the construction zone. The slide tracks may be supported to be vertically adjustable directly upon their foundations, which may be the footing of the foundation or concrete slab. In addition, the bottom formwork is capable of being cleaned after it has been released from a formed section whereby it may be easily replaced and reused in the formation of a successive section. The bottom formwork is advantageously arranged behind the stationary parts of the overall formwork means, as seen in the direction of launching. A reinforcement means for the section of the structure which is to be next poured may be arranged on the bottom formwork with the reinforcement being moved together with the bottom formwork into the region of the stationary formwork parts while the bottom formwork of a previously completed section of the structure is disengaged for reuse, seen in the launching direction, forwardly of the stationary formwork.

Pull members extending beneath the structure are advantageously used to advance the structure in the construction direction. These pull members act upon the rearward ends of each of the last-completed sections and moving means cooperating with the pull members are provided, with the moving means being mechanically or hydraulically operated and supported relative to a stationary abutment.

Because of the fact that the pull members used for launching each section act, through special push brackets or similar suitable structures at the rearward end of the last section, from the beginning to the completion of the construction of the entire structure, the same means for pushing may be employed in a uniform manner.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
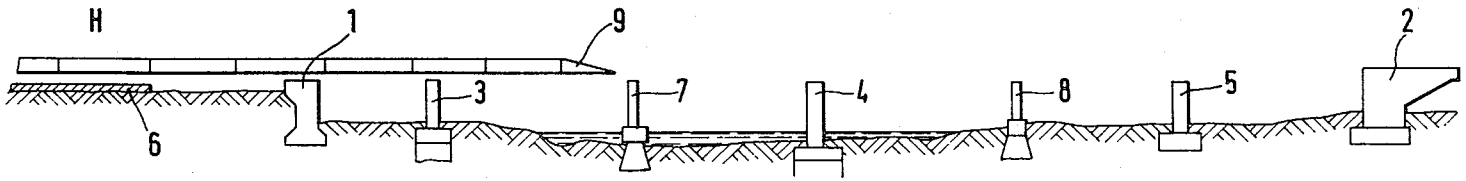
FIG. 1 is a side elevation showing the site where a bridge structure is to be erected.

Referring now to the drawings wherein like reference numerals are used to refer to similar parts throughout the various figures thereof, there is shown in FIG. 1 the site at which a bridge or similar elongated structure is to be erected. As will be noted from FIG. 1, the bridge is intended to extend from a first end where an abutment or support member 1 is provided to a second end where an abutment or support member 2 is provided. When the bridge has been completed and is in its final state of construction, the bridge superstructure will rest upon piers 3, 4 and 5. Intermediate temporary supports 7 and 8 are also shown but it is intended that these will be removed after completion of the bridge.

The bridge which is to be erected is constructed in individual sections at a construction zone H which is provided at a point immediately behind the abutment 1, taken in the direction of erection or launching of the bridge structure. As will be apparent from FIG. 1, the bridge structure is erected at the construction zone H in individual sections and then is launched toward the right in the direction of the abutment 2. The construction zone H essentially consists of two or more vertically adjustable slide tracks 6 which may be mounted upon provisional foundations located at the zone H.

Additionally, formwork means within which the concrete for forming the bridge superstructure is poured are provided at the construction zone H, the formwork means including a bottom formwork, as will be described more clearly hereinafter.

At the construction zone H, individual sections of the bridge superstructure are successively constructed and they are connected to each other. After each section of the superstructure has been completed, the completed portion is launched beyond the abutment 1 with the aid of slide bearings. The intermediate supports 7 and 8 are provided for reasons of static considerations. In order to make it possible during launching to cantilever the foremost bridge span without exceeding permissible stresses in the bridge superstructure, a nose 9 is provided at the forward end of the superstructure. The nose 9 may essentially consist of a light steel structure in order to facilitate early support at a next pier of the launched superstructure without significantly increasing the bending moment exerted thereon.

Figure 2:
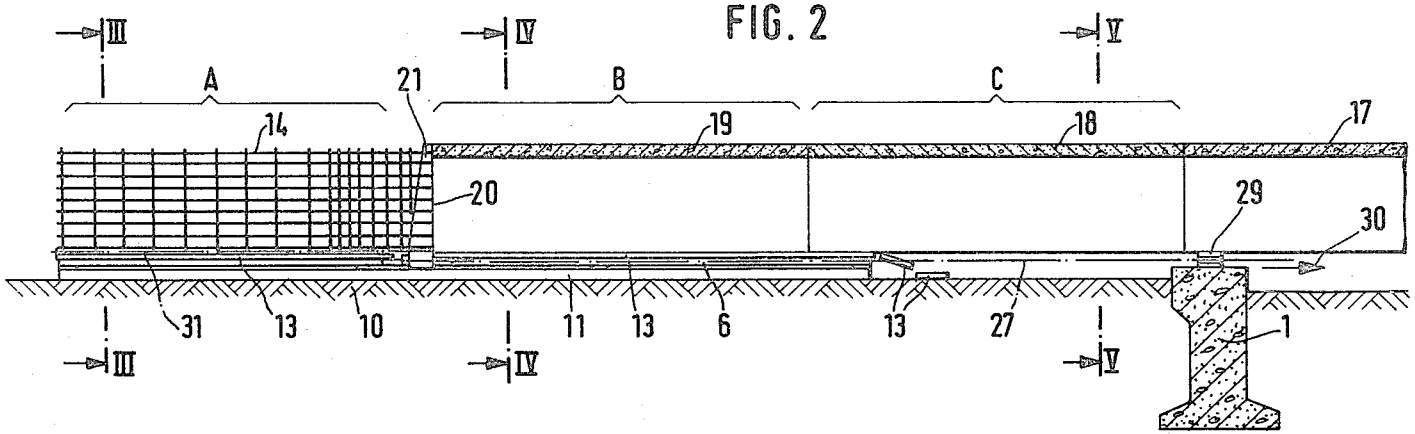
FIG. 2 is a side elevation partially in section taken through a part of the erection site of FIG. 1.
Figure 3:
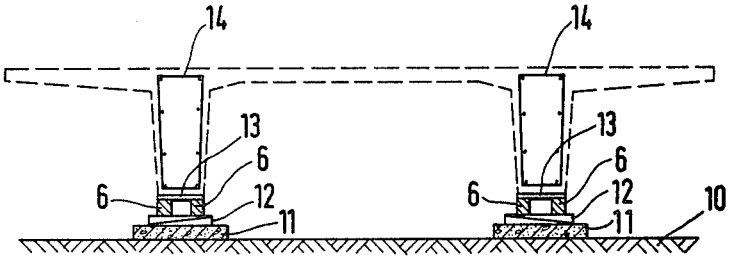
FIG. 3 is a cross-sectional view taken along the line III—III of FIG. 2.
Figure 4:
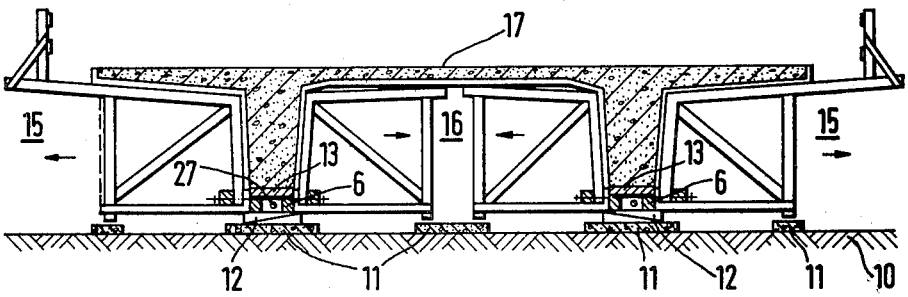
FIG. 4 is a cross section taken along the line IV—IV of FIG. 2.
Figure 5:
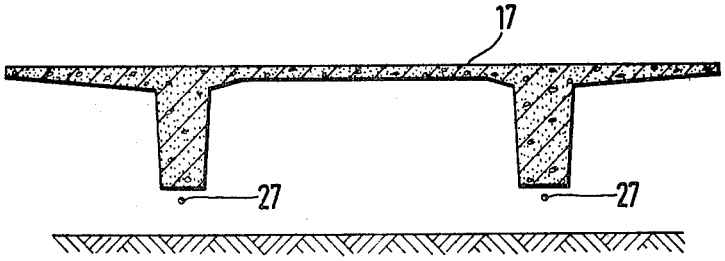
FIG. 5 is a cross section taken along the line V—V of FIG. 2.

The construction zone H behind the abutment 1 is shown in larger scale in the sectional elevational view of FIG. 2 and is also shown in the cross-sectional views of FIGS. 3–5. The construction zone H is divided into three sections A, B and C. In section A, a reinforcement for the girder webs and, possibly, for the deck slab of the bridge are prepared. In section B, each section of the superstructure is constructed and in section C the section of the superstructure last completed is released from the formwork means and from the slide tracks of the construction zone. In section C also, certain finishing operations can be performed such as, for example, mounting of protective railings, construction of cross girders, etc.

In the disclosure which follows, the construction of a double-webbed T-beam will be explained by way of example. The slide tracks 6 are placed upon two concrete foundation strips 11 which have been built upon a ground formation 10. In the simplest case, for example, in small bridge cross sections, the slide tracks 6 will consist of wooden beams. The formwork means include a bottom formwork 13 for the girder webs which is placed on the slide tracks 6 which, in turn, rest upon wood wedges 12 or other suitable adjustable supports in order to facilitate correction of the vertical orientation of the tracks 6. It is usually sufficient to utilize a launching grease or lubricant and under more demanding and difficult conditions, plates or disks of polytetrafluoroethylene (PTFE) can be used. In the construction of the bridge superstructure, first a reinforcement 14 for the girder webs is prepared on the bottom formwork 13 in section A. Subsequently, when the entire portion of the superstructure constructed thus far is moved by a further length of a section of the structure, the formwork 13 is moved together with the reinforcing cages into the section B. In section B there are the falsework and formwork parts 15 for the outside surfaces of the girder webs, and the cantilevers of the deck plate of the superstructure cross section, as well as an interior formwork 16 for the inner surfaces of the girder webs and the bottom side of the deck plate. The bottom formwork 13 is now located between the formwork parts and the interior formwork 16. In section A, a new bottom formwork will be placed on the slide tracks 6. In section B, the concrete of another section of the structure can now be poured.

In the representation of FIG. 2, the last section of the structure that has been completed is the section 19. This is joined to the section 18, which, in turn, follows a preceding section 17. After the concrete of section 19 of the structure has hardened, push brackets 21 are applied at its rearward end face 20 approximately in the region of the vertical axes of the girder webs.

Figure 7:
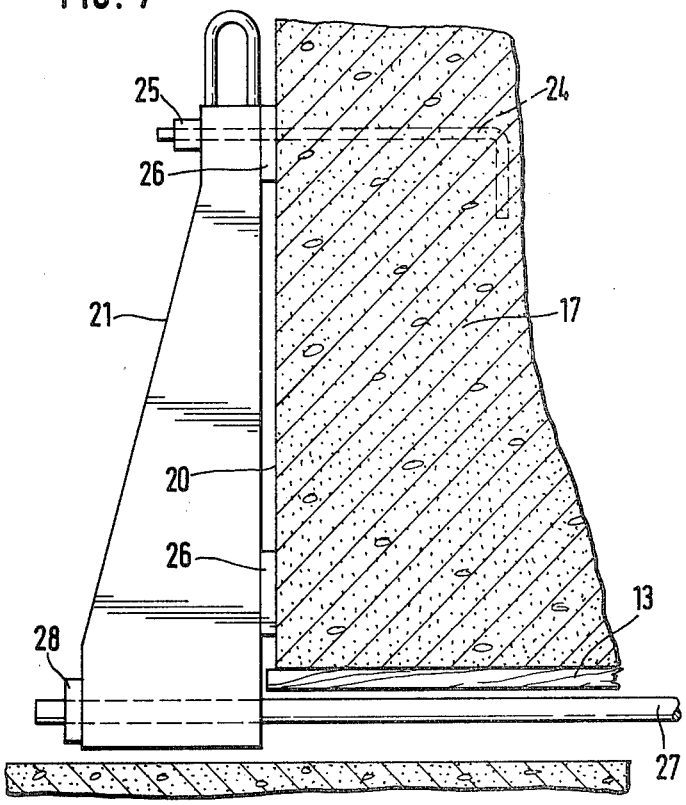
FIGS. 7 and 8 are, respectively, a side view and a rear view of push brackets which are utilized in the method of the present invention.
Figure 8:
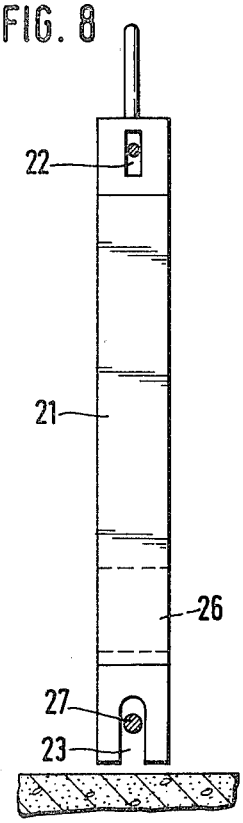

One of the push brackets which is utilized is shown in larger scale in FIGS. 7 and 8. The bracket comprises a steel part which has in its upper region a breakthrough 22 and in the lower region a slot 23. Through the upper slot there extends an anchoring rod 24 which is encased in concrete and which is fixed relative to the bracket 21 by means of a clamp or nut 25. The push bracket rests against the end face 20 of bridge portion or section 17 with a pressure cushion 26, which may, for example, be of neoprene, being arranged therebetween. Through the lower slot 23 there extends a pull rod 27 which advantageously is formed with a thread so that it may be anchored at the backside of the bracket by means of a nut 28. Arranged at the upper end of the bracket is a loop, through which a connection may be effected with a lifting device, for example, a crane mechanism or the like.

The pull rods 27 extend beneath the superstructure up to the abutment 1. The superstructure rests upon slide bearings 29 which are arranged on the abutment 1 and also on other supports. In this region there will be provided hydraulic presses which are supported by the abutment 1 and which push the pull rods in the direction of the arrow 30. In this manner, the section 19 of the structure may be launched and made to travel to the location which had been previously occupied by the section 18. In so doing, individual parts of the bottom formwork 13 will be released and they may subsequently be cleaned and moved back to section A for reuse. During this launching procedure, the bottom formwork may also be advantageously moved out of the section A by means of additional pull rods 31.

Figure 6:
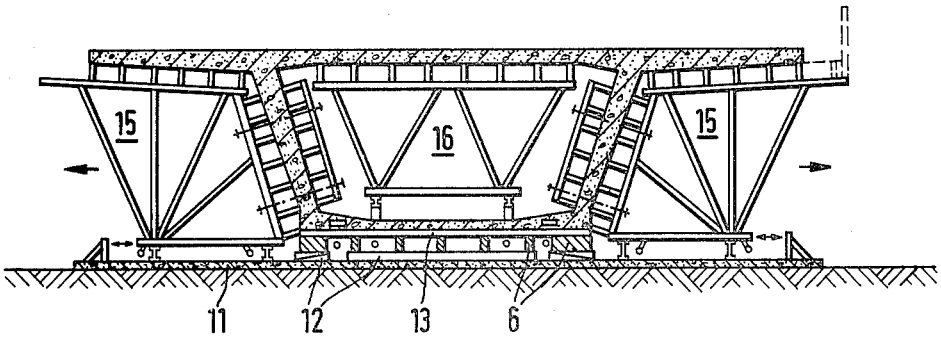
FIG. 6 is a cross-sectional view through a further example of a bridge structure having a hollow box cross section.

Of course, it is also possible to erect structures having other cross sections; for example, hollow box cross sections. FIG. 6 depicts such a cross section wherein essentially the same parts appear as in the T-beam cross section described in connection with FIGS. 2–5.

While specific embodiments of the invention have been shown and described in detail to illustrate the application of the inventive principles, it will be understood that the invention may be embodied otherwise without departing from such principles.

What is claimed is:

1. A method for erecting elongated structures, particularly multiple-span bridge superstructures of concrete, across an erection site comprising the steps of: establishing a construction zone at one end of the erection site; providing at said construction zone formwork means within which said structure may be formed in discrete sections; constructing said formwork means to include a formwork bottom and a stationary formwork remainder, with said formwork bottom being separable from said stationary remainder; forming said structure in said formwork means in discrete successive sections; joining each of said successively formed sections to a previously formed section and launching said sections in series from said construction zone to the opposite end of said erection site; providing means for moving said formwork bottom from said erection site in said launching direction together with each of said formed sections of said structure; performing said launching of said sections in series from said construction zone by moving said formwork bottom together with each section formed at said construction zone through one section length in the launching direction across said erection site while maintaining said formwork remainder stationary at said construction site; and subsequently separating said formwork bottom from said formed sections at a location spaced forwardly of said construction site after launching said sections therefrom.

2. The method according to claim 1 wherein said formwork bottom is arranged behind said stationary remainder of said formwork means, wherein reinforcement means for a section of said structure which is next to be formed are prepared on said formwork bottom, and wherein said reinforcement means together with said formwork bottom are moved into a region of said stationary formwork remainder while the formwork bottom of a previously completed section is released forwardly of said stationary formwork remainder, as seen in the launching direction.

3. A method according to claims 1 or 2 wherein pull members are used for launching said structure which extend beneath said structure, said pull members acting at the rearward end of a last-completed section, and wherein moving means are provided to act on said pull members, said moving means being supported by a stationary abutment.

4. A method according to claim 3 wherein push brackets having ends which project beyond the bottom edge of the cross section of said superstructure are provided, said pull members being anchored at said projecting ends of said push brackets resting against the free rearward end face of a last-completed section of said structure.

* * * * *